US009507296B2

(12) United States Patent
Kubo et al.

(10) Patent No.: US 9,507,296 B2
(45) Date of Patent: Nov. 29, 2016

(54) INTERMEDIATE TRANSFERER AND IMAGE FORMING APPARATUS USING THE SAME

(71) Applicants: Hidetaka Kubo, Kanagawa (JP); Atsufumi Hanazawa, Tokyo (JP); Jun Aoto, Kanagawa (JP); Daisuke Aoki, Kanagawa (JP)

(72) Inventors: Hidetaka Kubo, Kanagawa (JP); Atsufumi Hanazawa, Tokyo (JP); Jun Aoto, Kanagawa (JP); Daisuke Aoki, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/617,997

(22) Filed: Feb. 10, 2015

(65) Prior Publication Data

US 2015/0241817 A1 Aug. 27, 2015

(30) Foreign Application Priority Data

Feb. 25, 2014 (JP) ..... 2014-033535

(51) Int. Cl.
*G03G 15/01* (2006.01)
*G03G 15/16* (2006.01)

(52) U.S. Cl.
CPC ..... *G03G 15/162* (2013.01)

(58) Field of Classification Search
CPC ..... G03G 15/162; G03G 15/1615; G03G 15/0189; G03G 15/1605
USPC ..... 399/302
See application file for complete search history.

(56) References Cited

U.S. PATENT DOCUMENTS

| | | | |
|---|---|---|---|
| 5,099,285 A | 3/1992 | Hirano et al. | |
| 5,142,330 A | 8/1992 | Hirano et al. | |
| 5,168,312 A | 12/1992 | Aoto et al. | |
| 5,266,436 A | 11/1993 | Aoto et al. | |
| 5,379,097 A | 1/1995 | Aoto et al. | |
| 5,655,199 A | 8/1997 | Yamashita et al. | |
| 5,741,616 A | 4/1998 | Hirano et al. | |
| 5,761,594 A | 6/1998 | Seto et al. | |
| 5,774,775 A | 6/1998 | Aoto et al. | |
| 5,871,876 A | 2/1999 | Ikuno et al. | |
| 5,873,018 A | 2/1999 | Aoto et al. | |
| 6,136,483 A | 10/2000 | Suzuki et al. | |
| 2005/0069357 A1 | 3/2005 | Kabata et al. | |
| 2007/0110488 A1 | 5/2007 | Kabata et al. | |
| 2008/0199218 A1 | 8/2008 | Suzuki et al. | |
| 2008/0199233 A1* | 8/2008 | Matsunaka et al. | 399/336 |

(Continued)

FOREIGN PATENT DOCUMENTS

| | | |
|---|---|---|
| JP | 2007-099973 | 4/2007 |
| JP | 2007-099977 | 4/2007 |

(Continued)

OTHER PUBLICATIONS

Machine translation of Yamashita JP 2013-029632 A, publication date: Feb. 7, 2013.*

*Primary Examiner* — Walter L Lindsay, Jr.
*Assistant Examiner* — Frederick Wenderoth
(74) *Attorney, Agent, or Firm* — Cooper & Dunham LLP

(57) ABSTRACT

An intermediate transferer includes a substrate; and a surface layer overlying the substrate. The surface layer includes a crosslinked material, including a polyrotaxane including a circular molecule; a straight-chain molecule including the circular molecule in a skewering form; and a block group located at both ends of the straight-chain molecule, preventing the circular molecule from releasing, and at least one resin selected from the group consisting of acrylic resins, fluoreresins and silicone resins.

15 Claims, 3 Drawing Sheets

(56) References Cited

U.S. PATENT DOCUMENTS

| | | | | |
|---|---|---|---|---|
| 2009/0208258 | A1 | 8/2009 | Aoto | |
| 2011/0042856 | A1 | 2/2011 | Aoto et al. | |
| 2011/0177238 | A1 | 7/2011 | Aoto et al. | |
| 2011/0293824 | A1 | 12/2011 | Aoto et al. | |
| 2012/0082488 | A1 | 4/2012 | Kubo et al. | |
| 2012/0201578 | A1 | 8/2012 | Mashiko et al. | |
| 2012/0230740 | A1 | 9/2012 | Mikami et al. | |
| 2013/0004212 | A1 | 1/2013 | Kubo et al. | |
| 2013/0129395 | A1 | 5/2013 | Kubo et al. | |
| 2013/0223886 | A1* | 8/2013 | Miyagawa | G03G 13/025 399/176 |
| 2013/0240793 | A1* | 9/2013 | Yoshizawa | G03G 15/162 252/500 |
| 2013/0334014 | A1 | 12/2013 | Mashiko et al. | |
| 2014/0079445 | A1 | 3/2014 | Katoh et al. | |
| 2014/0248069 | A1 | 9/2014 | Kubo et al. | |
| 2014/0248070 | A1 | 9/2014 | Kubo et al. | |

FOREIGN PATENT DOCUMENTS

| | | |
|---|---|---|
| JP | 2007-099989 | 4/2007 |
| JP | 2007-099993 | 4/2007 |
| JP | 2007-212921 | 8/2007 |
| JP | 2011-248288 | 12/2011 |
| JP | 2012-158724 | 8/2012 |
| JP | 2012-181244 | 9/2012 |
| WO | WO2009/145173 A1 | 12/2009 |

* cited by examiner

INTERMEDIATE TRANSFERER AND IMAGE FORMING APPARATUS USING THE SAME

CROSS-REFERENCE TO RELATED APPLICATIONS

This patent application is based on and claims priority pursuant to 35 U.S.C. §119 to Japanese Patent Application No. 2014-033535, filed on Feb. 25, 2014, in the Japan Patent Office, the entire disclosure of which is hereby incorporated by reference herein.

BACKGROUND

1. Technical Field

The present invention relates to an intermediate transferer equipped in image forming apparatuses such as copiers and printers, particularly to an intermediate transferer preferably used in full-color image formation and to an image forming apparatus using the same.

2. Description of the Related Art

In the conventional art, a belt, especially a seamless belt, has been used for various purpose, as a member in an electrophotographic image forming apparatus. In recent years, an intermediate transfer belt system has been used in a full color image forming apparatus, where the intermediate transfer belt system includes superimposing developed images of four colors, yellow, magenta, cyan, and black temporarily on an intermediate transfer member, and collectively transferring the superimposed images onto a transfer medium, such as paper.

As for the aforementioned intermediate transfer belt, a system using developing units of four respective colors to one photoconductor has been used, but this system has a problem that a printing speed thereof is slow. Accordingly, to achieve high speed printing, a quarto-tandem system has been used, where the tandem system includes providing photoconductors of four respective colors, and an image of each color is continuously transferred to paper. In this system, however, it is very difficult to accurately position images of colors to be superimposed, as the paper is affected by the fluctuations of the environment, which causing color shift in the image. Accordingly, currently, an intermediate transfer belt system has been mainly adapted for the quarto-tandem system.

Under the circumstances as mentioned above, the higher requirements for properties (high speed transferring, and accuracy for positioning) of a intermediate transfer belt have been demanded than before, and therefore it is necessary for an intermediate transfer belt to satisfy these requirements. Especially for the accuracy for positioning, it has been required to inhibit variations caused by deformation of an intermediate transfer belt itself, such as stretching, after continuous use thereof. Moreover, an intermediate transfer belt is desired to have flame resistance as it is provided over a wide region of a device, and high voltage is applied thereto for transferring. To satisfy these demands, a polyimide resin or a polyamideimide resin that is a highly elastic and highly heat resistant resin, has been mainly used as a material of an intermediate transfer belt.

However, since an intermediate transfer belt formed of a polyimide resin has high strength and high surface hardness, it applies high pressure to a toner layer when transferring a toner image, resulting in occasional void images because a toner unevenly aggregates and a part of an image is not transferred. In addition, the intermediate transfer belt has low followability with a contact member such as a photoconductor and a paper, resulting in occasional uneven transfer because of partial defective contact (gap).

Recently, full-color electrophotographic images have been more frequently formed on various papers such as slippery coated papers having high smoothness, and recycle papers, emboss papers, Japanese papers and craft papers having rough surfaceness. The followability on papers having different surfaceness has importance, and poor followability causes uneven image density or color tone.

In order to solve this problem, various intermediate transfer belts each formed of a substrate and an elastic layer comparatively having flexibility layered thereon are disclosed. However, a surface layer having flexibility decreases in transfer pressure and releasability although improving in followability to paper convexities and concavities. Therefore, a toner does not release well therefrom, resulting in lowering of transfer efficiency. Further, it has lower abrasion resistance and scratch resistance.

In order to solve this problem, a method of forming a protection layer is disclosed. However, when a material having fully high transferability is coated on the flexible layer, it is unable to follow flexibility thereof, resulting in crack or peeling.

Japanese Patent No. JP-4810673-B2 (Japanese published unexamined application No. JP-2007-212921-A) discloses a double-layered intermediate transferer including a substrate and a surface layer overlying the substrate, in which the outermost surface has higher hardness to improve transferability. However, this still has poor followability to recycle papers, emboss papers, Japanese papers and craft papers having rough surfaceness and low transferability.

Japanese Patent No. JP-4973781-B2 (WO2009/145173) discloses a double-layered intermediate transferer including a substrate, an elastic layer overlying the substrate, a surface layer overlying the elastic layer, in which the surface layer is a thin film hard coating to improve durability and transferability. However, this still has hard outermost surface and low followability to papers having rough surfaceness.

Japanese published unexamined application No. JP-2012-181244-A discloses polyrotaxane used in a surface layer of a photoconductor improves durability thereof. However, this relates to a photoconductor, and differs from the present invention. Japanese Patents Nos. JP-4376846-B2, JP-4376848-B2, JP-4376849-B2 and JP-4385165-B2 (Japanese published unexamined applications Nos. JP-2007-099973-A, JP-2007-099989-A, JP-2007-099993-A and JP-2007-099977-A, respectively) relate to automotive paints.

Japanese Patent No. JP-5071564-B2 (Japanese published unexamined application No. JP-2012-158724-A) discloses a surface layer formed of a material in which polyurethane which is a polymer of an acrylic resin and isocyanate, and polyimide are mixed to improve damage reparability and transferability. However, compatibility between polyurethane and polyimide is low, which causes uneven hardness. In addition, images are likely to have spot uneven image density. Further, followability to transfer media and toner releasability are not improved, and uneven transfer is not solved yet. Further, an untransferred toner is not removed by a cleaning blade from a layer having flexibility.

SUMMARY

Accordingly, one object of the present invention is to provide an intermediate transferer having flexibility, good toner releasability, high transferability regardless of transfer media and high cleanability with a cleaning blade.

Another object of the present invention is to provide an image forming apparatus using the intermediate transferer.

These objects and other objects of the present invention, either individually or collectively, have been satisfied by the discovery of an intermediate transferer including a substrate; and a surface layer overlying the substrate, wherein the surface layer comprises a crosslinked material including a polyrotaxane including a circular molecule; a straight-chain molecule including the circular molecule in a skewering form; and a block group located at both ends of the straight-chain molecule, preventing the circular molecule from releasing, and at least one resin selected from the group consisting of acrylic resins, fluoreresins and silicone resins.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION

Figure 1:
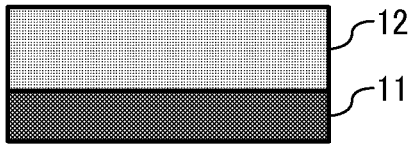
FIG. 1 is a schematic view illustrating a preferred embodiment of layer structure of the intermediate transferer of the present invention.

The present invention provides an intermediate transferer having high transferability regardless of transfer media and its surfaceness, and high cleanability with a cleaning blade.

In the electrophotographic image forming apparatuses, seamless belts are used for some members. A seamless intermediate transfer belt is one of important members, satisfying high electrical properties.

Exemplary embodiments of the present invention are described in detail below with reference to accompanying drawings. In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

The intermediate transferer of the present invention is preferably used in an image forming apparatus using an intermediate transfer belt [in which plural developed color toner images sequentially formed on an image bearer (photoconductor drum) are sequentially overlapped on the intermediate transfer belt as a first transfer, and then the first transferred image is transferred onto a recording medium as a second transfer.

FIG. 1 is a schematic view illustrating a preferred embodiment of layer structure of the intermediate transferer of the present invention, in which a flexible surface layer 12 is layered on a rigid substrate 11 which is comparatively flexible.

<Substrate>

First, the substrate 11 is explained. The substrate is formed of, e.g., a resin including a filler (or an additive) regulating electrical resistance, i.e., an electrical resistance regulator. Specific examples of the resin include, but are not limited to, fluoreresins such as PVDF and ETFE, polyimide resins or polyamideimide resins in terms of incombustibility. Particularly, polyimide resins or polyamideimide resins are preferably used in terms of mechanical strength (high elasticity) and heat resistance.

Specific examples of the electrical resistance regulator include, but are not limited to, metal oxide, carbon black, an ion conductive agent, and an electric conductive polymer material.

Specific examples of the metal oxide include, but are not limited to, zinc oxide, tin oxide, titanium oxide, zirconium oxide, aluminum oxide, and silicon oxide. Other examples thereof include products obtained by subjecting the above metal oxide to a surface treatment for improving dispersibility thereof. Specific examples of the carbon black include, but are not limited to, ketjen black, furnace black, acetylene black, thermal black and gas black. Specific examples of the ion conductive agent include, but are not limited to, a tetra alkyl ammonium salt, a trialkylbenzyl ammonium salt, an alkylsulfonic acid salt, an alkylbenzenesulfonic acid salt, alkyl sulfate, glycerin fatty acid ester, sorbitan fatty acid ester, polyoxyethylenealkylamine, ester of polyoxyethylene aliphatic alcohol, alkyl betaine, and lithium perchlorate. These can be used alone or in combination.

The electrical resistance regulators in this embodiment are not limited to the above. A coating liquid including at least a resin for preparing a seamless belt of this embodiment may further include an additive such as a dispersion auxiliary, a reinforcing agent, a lubricant, a heat-transfer agent and an antioxidant.

When a seamless belt is used as the intermediate transfer belt, carbon black is included in its layers such that the electric resistance thereof is $1\times10^{8}\Omega/\square$ to $1\times10^{15}\Omega/\square$ in the surface resistance when 500 V is applied thereto, and $1\times10^{8}$ $\Omega\cdot$cm to $1\times10^{14}$ $\Omega\cdot$cm in the volume resistance when 100 V is applied thereto. However, in terms of mechanical strength, carbon black is included in the layers in such an amount as they are not fragile and easily cracked. Namely, a coating liquid including the resin (a polyimide resin precursor or a polyamideimide resin precursor) and the electrical resistance regulator in suitable amounts, respectively is preferably used to prepare a seamless belt having a good balance between electrical properties (surface resistivity and volume resistivity) and mechanical strength.

The substrate preferably has a thickness of from 30 to 150 μm, more preferably from 40 to 120 μm, and most preferably from 50 to 80 μm. When not less than 30 μm, the belt does not tear due to cracks. When not greater than 150 μm, the belt does not crack. When from 50 to 80 μm, the belt has an advantage in terms of durability.

The thickness of the substrate is measured by a contact or an eddy current type thickness meter, or a cross section thereof is measured by a scanning electron microscope (SEM).

When the electrical resistance regulator is the carbon black, the content thereof is preferably from 10 to 25% by weight, and more preferably from 15 to 20% by weight. When the electrical resistance regulator is the metal oxide, the content thereof is preferably from 1 to 50% by weight, more preferably from 10 to 30% by weight. When the content is too low, the resistance is difficult to have uniformity and largely varies relative to arbitrary potentials. When too much, the intermediate transfer belt deteriorates in mechanical strength for practical use.

General-purpose polyimide and polyamideimide from manufacturers such as Du Pont-Toray Co., Ltd., Ube Industries, Ltd., New Japan Chemical Co., Ltd., JSR, Unitika Ltd., IST Corp., Hitachi Chemical Co., Ltd., Toyobo Co., Ltd. and Arakawa Chemical Industries Co., Ltd. can be sued as polyimide and polyamideimide in the present invention.

<Surface Layer>

Next, the surface layer 12 on the substrate 11 is explained. The surface layer may include a crosslinked material including a polyrotaxane including a circular molecule; a straight-chain molecule including the circular molecule in a skewering form; and a block group located at both ends of the straight-chain molecule, preventing the circular molecule from releasing, and at least one resin selected from the group consisting of acrylic resins, fluoreresins and silicone resins. The crosslinked material is preferably a copolymer formed by crosslinking a structural unit coming from the polyrotaxane and a structural unit coming from the at least one member selected from the group consisting of acrylic resins, fluoreresins and silicone resins with a hardener such as isocyanate. Consequently, the surface layer has flexibility owing to polyrotaxane and high transferability owing to acrylic resins, fluoreresins or silicone resins.

<Polyrotaxane>

Figure 2:
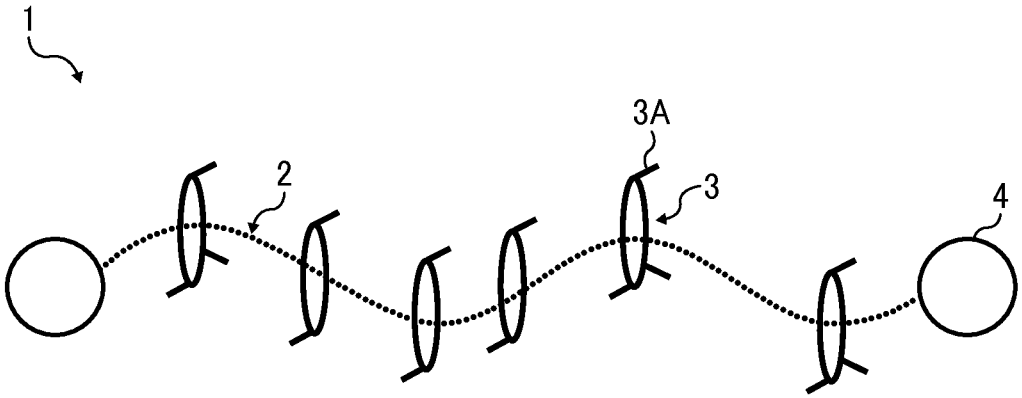
FIG. 2 is a schematic view conceptionally illustrating a basic structure of the polyrotaxane used in the present invention.

FIG. 2 is a schematic view conceptionally illustrating a basic structure of the polyrotaxane used in the present invention. Rotaxane is a molecule in which a dumbbell-shaped straight-chain molecule passes through a circular molecule. The polyrotaxane includes a polymer such as polyethyleneglycol as the axial molecule and plural circular molecules such as cyclodextrin fitted therein. The both dumbbell-shaped ends play a role as a block group preventing the circular molecules from releasing. The dumbbell-shaped straight-chain molecule having block groups at both ends is not covalently boded with the circular molecules.

Therefore, the straight-chain molecule can freely move through the circular molecules, and the circular molecules can move along the straight-chain molecule.

At least one of the straight-chain molecule and the circular molecules forming polyrotaxane may have a lipophilic modification group. Consequently, polyrotaxane is easy to dissolve in an organic solvent, and easy to coat as a surface layer.

In the present invention, the lipophilic modification polyrotaxane is polyrotaxane in which at least one of the straight-chain molecule and the circular molecules has a lipophilic modification group. Specific examples of the lipophilic modification group include, but are not limited to, an alkyl group and a benzyl group.

In FIG. 2, the lipophilic modification polyrotaxane 1 includes the straight-chain molecule 2, cyclodextrin which is the circular molecule 3 and the block group 4 located at both ends of the straight-chain molecule. The block group 4 needs to be bulky enough not to release the cyclodextrin molecule from the straight-chain molecule having the terminal functional groups. The straight-chain molecule 2 penetrates through a hole (an opening) of the circular molecule 3 and is included thereby. The circular molecule 3 has a lipophilic modification group 3A. Namely, the circular molecule 3 freely moves along the straight-chain molecule 2 like a pulley. Consequently, elasticity, flexibility and followability to a transfer medium improve.

The straight-chain molecule may substantially have the shape of a straight-chain, and has only to have a reactive functional group bondable with the block group at the end. Specific examples of the straight-chain molecule include polyethylene glycol, and specific examples of the block group include an adamantane group.

The chain polymer molecule having a terminal functional group preferably has a molecular weight of from 1,000 to 50,000, more preferably from 10,000 to 40,000, and furthermore preferably from 20,000 to 35,000. When not less than 1,000, the pulley effect of the circular molecule is fully exerted. The coating film does not lower in flexibility, and scratch resistance and followability to a transfer medium do not deteriorate. When not greater than 50,000, the coating liquid does not have too high viscosity and appearances such as smoothness and glossiness do not deteriorate.

Any circular molecules can be used as the circular molecules in the polyrotaxane if they can move along the chain molecule. The circular molecule is not necessarily open completely and may be partly open so as not to release from the chain molecule. Further, the circular molecule preferably has a reactive group in terms of easily bonding with the lipophilic modification groups. Specific examples of the reactive group include, but are not limited to, hydroxyl groups, carboxyl groups and amino groups. The hydroxyl groups are preferably used because of not reacting with the block group when formed.

Any circular molecules can be used if they are not crosslinked with each other and capable of passing the chain polymer therethrough. Specific examples of the circular molecules include cyclodextrins and crown ethers. The cyclodextrins are preferably used in terms of easily forming a clathrate compound with an organic compound.

The cyclodextrins is a circular compound in which plural glucoses are linked by α-1,4-bonding. Particularly, α-, β- and γ-cyclodextrin formed of 6, 7 and 8 glucoses, respectively are preferably used. α-cyclodextrin is preferably used in terms of inclusivity. Modified dextrins in which at least one of hydroxyl groups of the cyclodextrins is substituted with an organic functional group are more preferably used in terms of improved solubility in solvents.

The circular molecules such as cyclodextrin can be used alone or in combination. The number (inclusive quantity) of the circular molecules included by the straight-chain molecule is not particularly limited as long as the circular molecules can freely move like pulleys along the straight-chain molecule.

The polyrotaxane preferably used in the present invention includes a circular molecule, a straight-chain molecule including the circular molecule in a skewering form and a block group located at both ends of the straight-chain molecule, preventing the circular molecule from releasing. The block group is an adamantane group and the circular molecule is α-cyclodextrin. A part or all of hydroxyl groups of the cyclodextrin are modified with a modification group. The modification group includes a modification group (—CO(CH2)5OH) formed by caprolactone bonded with —CH3H6-O—.

Polyrotaxane in the present invention can be prepared by a method disclosed in JP-4376849-B1, and generic products from manufacturers such as Advanced Softmaterials Inc. can also be used.

A crosslinked polyrotaxane is included I the surface layer of the intermediate transferer of the present invention. The crosslinked polyrotaxane is the polyrotaxane crosslinked with another polymer. The surface layer of the intermediate transferer of the present invention preferably includes a material formed by crosslinking polyrotaxane with at least one resin selected from the group consisting of acrylic resins, fluoreresins and silicone resins. Namely, the acrylic resins, the fluoreresins and the silicone resins are bonded with the polyrotaxane through the circular part thereof. Flexibility is higher when the polyrotaxane is used alone and followability to a transfer medium is good, but so high that an untransferred toner cannot be removed by a cleaning blade.

<Acrylic Resin>

Next, the acrylic resins are explained. The acrylic resins in the present invention is not particularly limited, and may be marketed products. However, among various crosslinking resins (hydroxyl groups, carboxyl groups, epoxy groups, alkyl groups and alkoxy silyl groups), the hydroxyl group resins or carboxyl group resins are preferably used in terms of reactivity with the polyrotaxane, and the hydroxyl group resins are more preferably used. Thermosetting acrylic resins, thermoplastic acrylic resins and UV curing acrylic resins can be used, and are not particularly limited. The thermosetting acrylic resins are most preferably used because of easily crosslinking with the polyrotaxane.

The acrylic resin may be a copolymer which is an acrylic monomer another monomer is introduced to. Specific examples of the monomer include, but are not limited to, silicone monomers and styrene monomers. Styrene monomers are preferably used in terms of improving transferability. Namely, styrene acrylic resins are preferably used as the acrylic resin.

Marketed products such as ARUFON series from Toagosei Co., Ltd. and DIANAL series from Mitsubishi Rayon Co., Ltd. can be used as the acrylic resins.

<Fluororesin>

Next, the fluoreresins are explained. The fluoreresins in the present invention may be marketed products, and are not particularly limited if they have a reactive group crosslinking with the polyrotaxane. However, among various crosslinking resins (hydroxyl groups, carboxyl groups, epoxy groups, alkyl groups and alkoxy silyl groups), vinylethers having the hydroxyl group or carboxyl group are preferably used in terms of easily crosslinking with the polyrotaxane through a hardener.

Therefore, the fluororesin is preferably a copolymer including a structural unit coming from fluoroethylene and a structural unit coming from vinyl ether. Further, it is preferable that the structural unit coming from fluoroethylene and structural unit coming from ethylene are regularly located alternately. The structural unit coming from fluoroethylene is preferably tetrafluoroethylene (4F) or trifluoroethylene (3F), and trifluoroethylene is most preferably used. Such a structure obtains higher transferability.

LUMIFLON is commercially available from Asahi Glass Co., Ltd. as 3F, ZEFFLE and MODIPER F are commercially available as 4F from Daikin Industries, Ltd. and NOF Corp., respectively. These fluororesins can be used alone or in combination.

<Silicone Resin>

Next, silicone resins are explained. In the present invention, silicone resin is a polymer having a segment formed of a silicone chain (—Si—O—Si—O—). Specific examples of the silicone resins include, but are not limited to, resins including a polysiloxane segment, resins including polydimethylsiloxane segment, silicone graft polymers and silicon block copolymers. These can be used alone or in combination. Among the silicone resins, a silicone resin including a functional group selected from at least one of a hydroxyl group (OH group) and a carboxyl group (COOH group) is preferably used to improve durability and prevent uneven distribution of materials. The functional group crosslinks with a modified polyrotaxane or a hardener and materials evenly fixed on the surface of the surface layer of the intermediate transferer, which improves durability and decreases uneven transfer (image density).

GLASCA, CERANATE, PSIMAC and MODIPER FS are commercially available from JSR Corp., DIC Corp. Toagosei Co., Ltd. and NOF Corp. as the silicone resins.

The surface layer of the present invention is formed by coating and drying a solution including an organic solvent, and the polyrotaxane and at least one resin selected from the group consisting of acrylic resins, fluororesins and silicone resins dissolved therein with a crosslinker (hardener). One, two or all three of the acrylic resin, fluororesin and silicone resin may be used. When two or more resins are used, all resins are preferably copolymerized with each other. At least only one of the resins may be copolymerized. When all the three resins are used, the content of the acrylic resin is preferably from 10 to 98% by weight, that of the fluororesin is from 1 to 45% by weight, and that of the silicone resin is from 1 to 45% by weight based on total weight of the resins.

Specific examples of the crosslinkers (hardeners) include melamine resins, polyisocyanate compounds, block isocyanate compounds, cyanuric chloride, trimesoyl chloride, terephthaloyl chloride, epichlorohydrin, dibromobenzene, glutaraldehyde, phenylenediisocyanate, tolylene diisocyanate, divinylsulfone, 1,1-carbonyldiimidazole or alkoxy silanes. These can be used alone or in combination. Isocyanate is preferably used in terms of crosslinkability. Block isocyanate is more preferably used because of high storage stability under normal temperature.

The block isocyanate includes an isocyanate group protected by a blocker such as oximes, diketones, phenols and caprolactams. This keeps stable in ordinary circumstances, and the blocker is dissociated when heated and an active isocyanate revives to perform a hardening or crosslinking reaction. Hexamethylenediisocyanate block diisocyanate is preferably used. Commercially available isocyanate hardeners such as DURANATE from Asahi Kasei Corp., TAKENATE from Mitsui Chemicals, Inc., CORONATE from Nippon Polyurethane Industry Co., Ltd. and DESMODUR from Sumika Bayer Urethane Co., Ltd. may be used.

In the present invention, the intermediate transferer does not necessarily have double layers, i.e., a substrate and a surface layer. It may have an intermediate layer when necessary. Specific examples of the intermediate layer include a primer layer to improve adhesiveness and an elastic layer such as comparatively soft elastomers and rubbers to improve followability to a transfer medium.

An example of preparing the belt of the present invention is explained. First, a method of preparing the substrate 11 is explained. A method of preparing the substrate with a coating liquid including at least a resin, i.e., a polyimide resin precursor or a polyamideimide resin precursor.

The substrate is formed by coating the coating liquid by known methods such as spiral coating, die coating and roll coating. A coating liquid including at least a resin, i.e., a polyimide resin precursor or a polyamideimide resin precursor is coated on a cylindrical mold, such as a cylindrical metal mold, by a liquid applicator such as a nozzle and a dispenser, while slowly rotating the cylindrical mold, so as to uniformly coat the outer surface of the cylindrical mold with the coating liquid, to thereby perform flow casting (forming a coating film). Thereafter, the rotational speed is increased to a predetermined speed. Once the rotational speed reaches the predetermined speed, the rotational speed is maintained constant, and the rotation is continued for a predetermined period. Then, the temperature is gradually elevated while rotating the cylindrical mold, to thereby evaporate the solvent in the coating film at the temperature of 80 to 150° C. It is preferred that the vapor (e.g., the evaporated solvent) in the atmosphere be efficiently circulated and removed. Once a self-supporting film is formed, the mold with the film is placed in a heating furnace (baking furnace) capable of performing a high temperature treatment. Then, the temperature of the furnace is increased stepwise, and eventually a high temperature heat treatment (baking) is performed at the temperature ranging from about 250 to about 450° C., to thereby sufficiently imidize or polyamideimidize the polyimide rein precursor or the polyamideimide rein precursor. After the substrate is fully cooled, the surface layer 12 is layered thereon. Polyrotaxane, at least one of an acrylic resin, a fluororesin and a silicone resin, and a crosslinker (hardener) are dissolved in an organic solvent to prepare a coating liquid. A ratio of the polyrotaxane to the resin is not particularly limited, and preferably from 7/3 to 3/7, and more preferably from 6/4 to 4/6 by weight. When the polyrotaxane is too much, followability to a transfer medium improves, but cleanability of the untransferred toner with the cleaning blade deteriorates. When too little, followability to papers and transferability deteriorate. This improves followability, releasability, transferability and cleanability.

An equivalent ratio of the acrylic resin, the fluororesin and the silicone resin is preferably adjusted such that a ratio of reaction groups of the hardener to the total of OH groups of from 1.0 to 1.2 when the hardener is a hydroxyl group. When the hardener is isocyanate, a ratio of NCO groups to the total of OH groups is preferably from 1.0 to 1.2. When less than 1.0, the crosslinkage is not fully performed, resulting in difficulty in keeping a form of the crosslinked material. When greater than 1.2, the crosslinked material becomes too hard and the surface layer occasionally has insufficient flexibility. The total of OH groups is the total of OH groups polyrotaxane, acrylic resin, fluororesin and silicone resin have. When acrylic resin, fluororesin and silicone resin have a carboxyl group, a ratio of NCO groups to the total of COOH groups and OH groups is preferably from 1.0 to 1.2.

The coating liquid is coated on the substrate, and dried and crosslinked (hardened) to form the surface layer thereon. Similarly to the methods of coating the substrate, known coating methods such as spiral coating, die coating, roll coating or spray coating can be used. A coating liquid is coated on a cylindrical mold, such as a cylindrical metal mold, by a liquid applicator such as a nozzle and a dispenser, while slowly rotating the cylindrical mold, so as to uniformly coat the outer surface of the cylindrical mold with the coating liquid. Thereafter, the predetermined rotational speed and the drying temperature are maintained for leveling. While rotated, the belt may be heated when necessary. Thus, a seamless belt is formed.

Further, materials such as a resistance regulator regulating electrical properties, a flame retardant to obtain flame retardancy, an antioxidant, a reinforcer, a filler, a vulcanization accelerator, a plasticizer may be used when necessary.

The surface layer coating liquid is heated to be crosslinked. The surface layer is preferably heated at from 130 to 220° C., and more preferably from 140 to 200° C. The surface layer is preferably crosslinked for 30 sec to 5 hrs. Known heating methods such as press heating, vapor heating, oven heating and hot air heating. After crosslinked once, the surface layer may be further crosslinked so as to be firmly crosslinked inside, preferably for 1 to 48 hrs by suitable heating methods at suitable temperature.

The surface layer preferably has a thickness of from 30 to 300 μm, and more preferably from 50 to 200 μm. When not less than 30 μm, image quality on papers having surface concavities and convexities is sufficient. When not greater than 300 μm, the belt is not too heavy to bend, does not unstably due to a large curve, and does not have a crack at an elbow-shaped part due to a suspension roller. The thickness (cross-section) is measured by a scanning electron microscope (SEM).

<Image Forming Apparatus>

The image forming apparatus of the present invention includes an image bearer a latent image is formed on and capable of bearing a toner image, an image developer developing the latent image formed on the image bearer with a toner, an intermediate transferer a toner image developed by the image developer is first transferred onto, and a transferer second transferring the toner image borne on the intermediate transferer to a recording medium, and other means such as a discharger, a cleaner, a recycler and a controller when necessary. In this case, the image forming apparatus is preferably a full-color image forming apparatus in which plural image bearers having an image developer for each color are located in series.

Referring now to the schematic views of essential parts, detail description will next be given to a seamless belt used in the belt constitution section of an image forming apparatus of the present invention. Note that the schematic views are exemplary ones, which should not be construed as limiting the present invention thereto.

Figure 3:
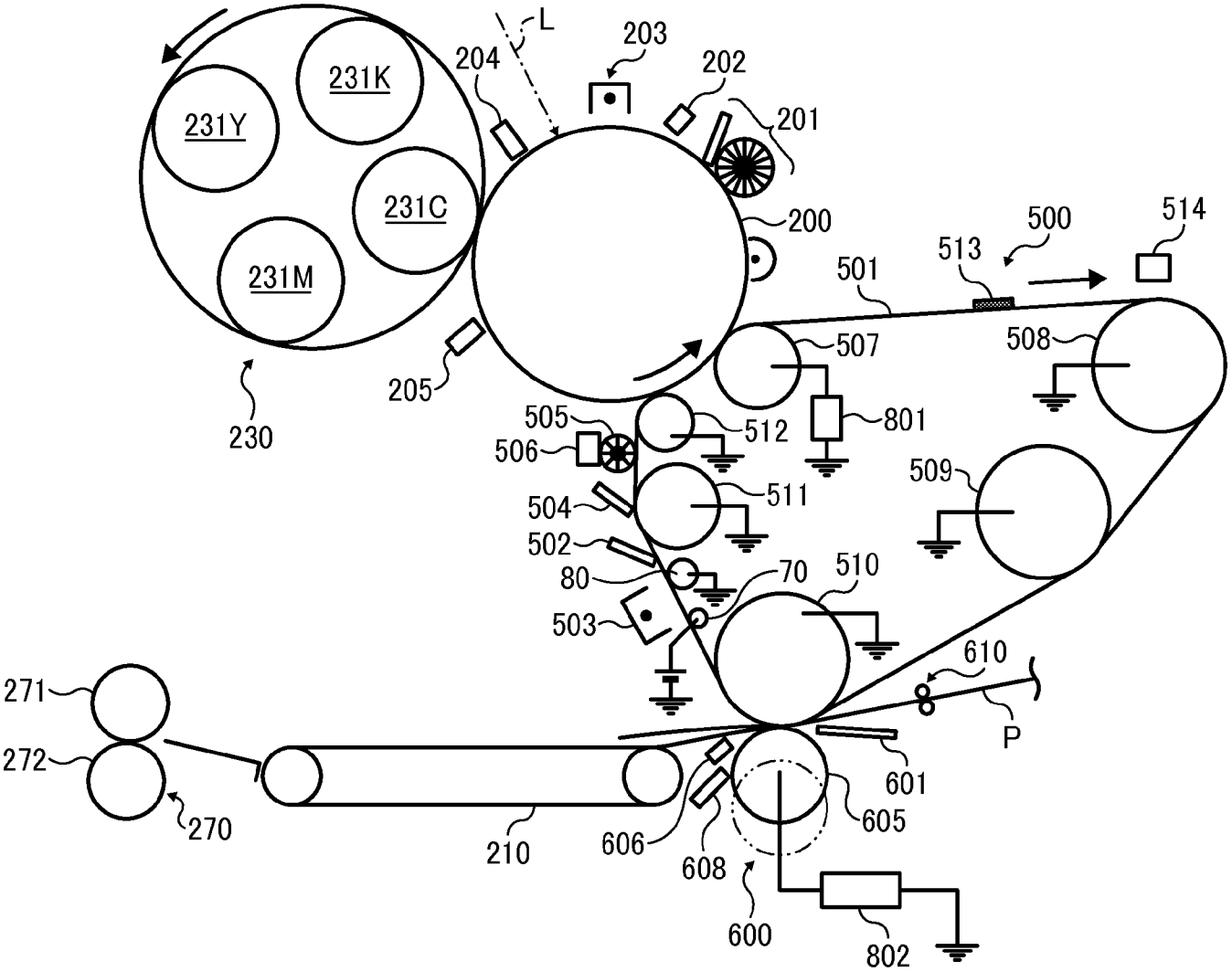
FIG. 3 is a schematic view illustrating a main part of an embodiment of image forming apparatus equipped with the intermediate transferer of the present invention as a belt member.

FIG. 3 is a schematic view illustrating a main part of an embodiment of image forming apparatus equipped with the intermediate transferer of the present invention as a belt member.

As shown in FIG. 3, an intermediate transfer unit 500 including a belt member, includes an intermediate transfer belt 501 as an intermediate transfer medium stretched around a plurality of rollers. Around the intermediate transfer belt 501, a secondary transfer bias roller 605 serving as a secondary transfer charge applying unit of a secondary transfer unit 600, a belt cleaning blade 504 as a cleaning unit for the intermediate transfer medium, and a lubricant applying brush 505 as a lubricant applying member of a lubricant applying unit, etc. are disposed facing the intermediate transfer belt 501.

The intermediate transfer belt 501 is stretched around the primary transfer bias roller 507 serving as a primary transfer charge applying unit, the belt driving roller 508, a belt tension roller 509, a secondary transfer opposing roller 510, a cleaning opposing roller 511, and a feedback current detecting roller 512. Each roller is formed of a conductive material, and respective rollers other than the primary transfer bias roller 507 are grounded. A transfer bias is applied to the primary transfer bias roller 507, the transfer bias being controlled at a predetermined level of current or voltage according to the number of superimposed toner images by means of a primary transfer power source 801 controlled at a constant current or a constant voltage.

The intermediate transfer belt 501 is driven in the direction indicated by an arrow by the belt driving roller 508, which is driven to rotate in the direction indicated by an arrow by a driving motor (not shown). The intermediate transfer belt 501 serving as the belt member is generally semiconductive or insulative, and has a single layer or a multi-layer structure. In the present invention, a seamless belt is preferably used, so as to improve durability and attain excellent image formation. Moreover, the intermediate transfer belt is larger than the maximum size capable of passing paper so as to superimpose toner images formed on a photoconductor drum 200.

The secondary transfer bias roller 605 is a secondary transfer unit, which is configured to be brought into contact with a portion of the outer surface of the intermediate transfer belt 501, which is stretched around the secondary transfer opposing roller 510 by means of an attaching/detaching mechanism as an attaching/detaching unit described below. The secondary transfer bias roller 605 which is disposed so as to hold a transfer paper P with a portion of the intermediate transfer belt 501 which is stretched around the secondary transfer opposing roller 510, is applied with a transfer bias of a predetermined current by the secondary transfer power source 802 controlled at a constant current.

A pair of registration rollers 610 feeds the transfer paper P as a transfer medium at a predetermined timing in between the secondary transfer bias roller 605 and the intermediate transfer belt 501 stretched around the secondary transfer opposing roller 510. With the secondary transfer bias roller 605, a cleaning blade 608 as a cleaning unit is in contact. The cleaning blade 608 performs cleaning by removing deposition deposited on the surface of the secondary transfer bias roller 605.

In a color copying machine having the above-mentioned construction, when an image formation cycle is started, the photoconductor drum 200 is rotated by a driving motor (not shown) in a counterclockwise direction indicated by an arrow, so as to form Bk (black), C (cyan), M (magenta), and Y (yellow) toner images on the photoconductor drum 200. The intermediate transfer belt 501 is driven in the direction of the arrow by means of the belt driving roller 508. Along with the rotation of the intermediate transfer belt 501, a formed Bk-toner image, a formed C-toner image, a formed M-toner image, and a formed Y-toner image are primarily transferred by means of a transfer bias based on a voltage applied to the primary transfer bias roller 507. Finally, the images are superimposed on one another in order of Bk, C, M, and Y on the intermediate transfer belt 501, to thereby form a color image.

For example, the Bk toner image is formed as follows.

In FIG. 3, a charger 203 uniformly charges a surface of the photoconductor drum 200 to a predetermined potential with a negative charge by corona discharging. Subsequently, at a timing determined based on signals for detecting marks on the belt, by the use of an optical writing unit (not shown) raster exposure is performed based on a Bk color image signal. When the raster image is exposed, a charge proportional to an amount of light exposure is removed and a Bk latent electrostatic image is thereby formed, in an exposed portion of the photoconductor drum 200 which has been uniformly charged. Then, by bringing a Bk toner charged to a negative polarity on the Bk developing roller of a Bk developing unit 231K into contact with the Bk latent electrostatic image, the Bk toner does not adhere to a portion where a charge remaining on the photoconductor drum 200, and the Bk toner adsorbs to a portion where there is no charge on the photoconductor drum 200, in other words a portion exposed to the raster light exposure, to thereby form a Bk toner image corresponding to the latent electrostatic image.

The Bk toner image formed on the photoconductor drum 200 is primarily transferred to the outer surface of the intermediate transfer belt 501 being in contact with the photoconductor drum 200, in which the intermediate transfer belt 501 and the photoconductor drum 200 are driven at an equal speed. After primary transfer, slightly remaining toner which has not been transferred from the photoconductor drum 200 to the intermediate transfer belt 501 is cleaned with a photoconductor cleaning unit 201 in preparation for a next image forming operation on the photoconductor drum 200. Next to the Bk image forming process, the operation of the photoconductor drum 200 then proceeds to a C image forming process, in which C image data is read with a color scanner at a predetermined timing, and a C latent electrostatic image is formed on the photoconductor drum 200 by a write operation with laser light based on the C image data.

A revolver development unit 230 is rotated after the rear edge of the Bk latent electrostatic image has passed and before the front edge of the C latent electrostatic image reaches, and the C developing unit 231C is set to a developing position, where the C latent electrostatic image is developed with C toner. From then on, development is continued over the area of the C latent electrostatic image, and at the point of time when the rear edge of the C latent electrostatic image has passed, the revolver development unit rotates in the same manner as the previous case of the Bk developing unit 231K to allow the M developing unit 231M to move to the developing position. This operation is also completed before the front edge of a Y latent electrostatic image reaches the developing position. As for M and Y image forming steps, the operations of scanning respective color image data, the formation of latent electrostatic images, and their development are the same as those of Bk and C, therefore, explanation of the steps is omitted.

Bk, C, M, and Y toner images sequentially formed on the photoconductor drum 200 are sequentially registered in the same plane and primarily transferred onto the intermediate transfer belt 501. Accordingly, the toner image whose four colors at the maximum are superimposed on one another is formed on the intermediate transfer belt 501. The transfer paper P is fed from the paper feed section such as a transfer paper cassette or a manual feeder tray at the time when the image forming operation is started, and waits at the nip of the registration rollers 610. The registration rollers 610 are driven so that the front edge of the transfer paper P along a transfer paper guide plate 601 just meets the front edge of the toner image when the front edge of the toner image on the intermediate transfer belt 501 is about to reach a secondary transfer section where the nip is formed by the secondary transfer bias roller 605 and the intermediate transfer belt 501 stretched around the secondary transfer opposing roller 510, and registration is performed between the transfer paper P and the toner image.

When the transfer paper P passes through the secondary transfer section, the four-color superimposed toner image on the intermediate transfer belt 501 is collectively transferred (secondary transfer) onto the transfer paper P by transfer bias based on the voltage applied to the secondary transfer bias roller 605 by the secondary transfer power source 802. When the transfer paper P passes through a portion facing a transfer paper discharger 606 formed of charge eliminating spines and disposed downstream of the secondary transfer section in a moving direction of a transfer paper guiding plate 601, a charge on the transfer paper sheet is removed and then the transfer paper P is separated from the transfer paper guiding plate 601 to be delivered to a fixing unit 270 via the belt transfer unit 210 which is included in the belt constitution section. Furthermore, a toner image is then fused and fixed on the transfer paper P at a nip portion between fixing rollers 271 and 272 of the fixing unit 270, and the transfer paper P is then discharged outside of a main body of the apparatus by a discharging roller (not shown) and is stacked in a copy tray (not shown) with a front side up. The fixing unit 270 may have a belt constitution section.

On the other hand, the surface of the photoconductor drum 200 after the toner images are transferred to the belt is cleaned by the photoconductor cleaning unit 201, and is uniformly discharged by a discharge lamp 202. After the toner image is secondarily transferred to the transfer paper P, the toner remaining on the outer surface of the intermediate transfer belt 501 is cleaned by the belt cleaning blade 504. The belt cleaning blade 504 is configured to be brought into contact with the outer surface of the intermediate transfer belt 501 at a predetermined timing by the cleaning member attaching/detaching mechanism not shown in the figure.

To the outer surface of the intermediate transfer belt 501 from which the remaining toner has been removed, a lubricant 506 is applied by scraping it with a lubricant applying brush 505. The lubricant 506 is formed of zinc stearate, etc. in a solid form, and disposed to be brought into contact with the lubricant applying brush 505. The charge remaining on the outer surface of the intermediate transfer belt 501 is removed by discharge bias applied with a belt discharging brush (not shown), which is in contact with the outer surface of the intermediate transfer belt 501. The lubricant applying brush 505 and the belt discharging brush are respectively configured to be brought into contact with the outer surface of the intermediate transfer belt 501 at a predetermined timing by means of an attaching/detaching mechanism (not shown).

When the copying operation is repeated, in order to perform an operation of the color scanner and an image formation onto the photoconductor drum 200, an operation proceeds to an image forming process of a first color (Bk) of a second sheet at a predetermined timing subsequent to an image forming process of the fourth color (Y) of the first sheet. As for the intermediate transfer belt 501, a Bk toner image of the second sheet is primarily transferred to the outer surface of the intermediate transfer belt 501 in an area of which has been cleaned by the belt cleaning blade 504 subsequent to a transfer process of the toner image of four colors on the first sheet of the transfer paper. Then, the same operations are performed for a next sheet as for the first sheet. Operations have been described in a copy mode in which full-color copies of four colors are obtained. The same operations are performed the number of corresponding times for specified colors in copy modes of three or two colors. In a monochrome-color copy mode, only the developing unit of a predetermined color in the revolver development unit 230 is put in a development active state until the copying operation is completed for the predetermined number of sheets, and the belt cleaning blade 504 is kept in contact with the intermediate transfer belt 501 while the copying operation is continuously performed.

In the above-mentioned embodiment, a copier having only one photoconductor drum 200 is described. However, the electrophotographic intermediate transfer belt of the present invention can be used, for example, in a tandem type image forming apparatus, in which a plurality of photoconductor drums are serially arranged along an intermediate transfer belt formed in the seamless belt.

Figure 4:
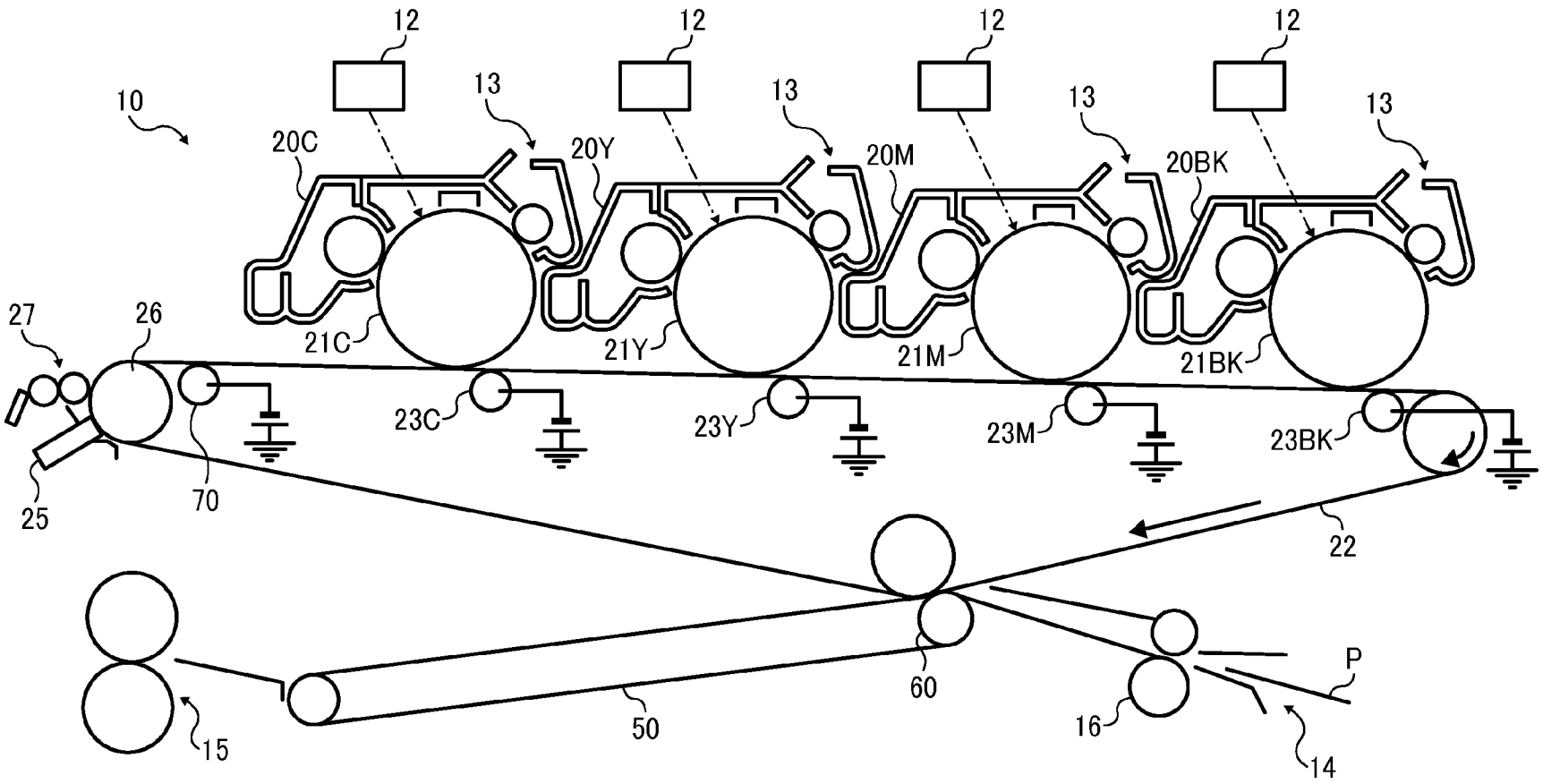
FIG. 4 is a schematic view illustrating a main part of another embodiment of image forming apparatus equipped with the intermediate transferer of the present invention as a belt member.

FIG. 4 is a schematic view illustrating a main part of another embodiment of image forming apparatus equipped with the intermediate transferer of the present invention as a belt member.

In FIG. 4, a main body of a printer 10 is constituted with image writing sections 12, image forming sections 13, paper feeding sections 14, for electrophotographic color image formation. Based on image signals, image processing operation is performed in an image processing section, and converted to color signals of black (Bk), magenta (M), yellow (Y), and cyan (C), and then color signals are transmitted to the image writing sections 12. The image writing sections 12 are laser scanning optical systems each including a laser light source, a deflector such as a rotary polygon mirror, a scanning imaging optical system, and mirrors, and have four optical writing paths corresponding to color signals, and perform image writing corresponding to respective color signals on image bearing members (photoconductors) 21Bk, 21M, 21Y, 21C provided for respective colors in the image forming sections 13.

The image forming sections 13 includes four photoconductors 21Bk, 21M, 21Y and 21C serving as image bearing member for Black (Bk), magenta (M), yellow (Y) and cyan (C), respectively. Generally, organic photoconductors are used as these photoconductors. Around each of the photoconductors 21Bk, 21M, 21Y, 21C, a charging unit, an exposure portion irradiated with laser beam from the image writing section 12, each of developing units 20Bk, 20M, 20Y, 20C, each of primary transfer bias rollers 23Bk, 23M, 23Y, 23C as a primary transfer unit, a cleaning unit (abbreviated), and other devices such as a discharging unit for the photoconductor (not shown) are arranged. Each of the developing units 20Bk, 20M, 20Y, 20C uses a two component magnet brush developing method. An intermediate transfer belt 22, which is the belt constitution section, is located between each of the photoconductors 21Bk, 21M, 21Y, 21C and each of the primary transfer bias rollers 23Bk, 23M, 23Y, 23C. Black (Bk), magenta (M), yellow (Y) and cyan (C) color toner images formed on the photoconductors 21Bk, 21M, 21Y, 21C are sequentially superimposingly transferred to the intermediate transfer belt 22.

The transfer paper P fed from the paper feeding section 14 is fed via a registration roller 16 and then held by a transfer conveyance belt 50 as a belt constitution section. The toner images transferred onto the intermediate transfer belt 22 are secondarily transferred (collectively transferred) to the transfer paper P by a secondary transfer bias roller 60 as a secondary transfer unit at a point in which the intermediate transfer belt 22 is brought into contact with the transfer conveyance belt 50. Thus, a color image is formed on the transfer paper P. The transfer paper P on which the color image is formed is fed to a fixing unit 15 via the transfer conveyance belt 50, and the color image is fixed on the transfer paper P by the fixing unit 15, and then the transfer paper P is discharged from the main body of the printer.

Toner particles remaining on the surface of the intermediate transfer belt 22, which has not been transferred in the secondary transfer process, are removed by a belt cleaning member 25. On a downstream side from the belt cleaning member 25 with respect to the rotation direction of the intermediate transfer belt 22, a lubricant applying unit 27 is provided. The lubricant applying unit 27 includes a solid lubricant and a conductive brush configured to rub the intermediate transfer belt 22 so as to apply the solid lubricant to the surface of the intermediate transfer belt 22. The conductive brush is constantly in contact with the intermediate transfer belt 22, so as to apply the solid lubricant to the intermediate transfer belt 22. The solid lubricant is effective to improve the cleanability of the intermediate transfer belt 22, thereby preventing occurrence of filming thereon, and improving durability of the intermediate transfer belt 22.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

Example 1

A substrate coating liquid was prepared as follows, and the substrate for a seamless belt was prepared with the coating liquid.

[Preparation of Substrate Coating Liquid]

First, a dispersion in which carbon black (Special Black 4 from Orion Engineered Carbons LLC) is previously dispersed by a beads mill in N-methyl-2-pyrrolidon was blended with a polyimide varnish (a solid content ratio of U-varnish A to U-varnish S is 6/4 from Ube Industries, Ltd.) including a polyamic acid which is a polyimide resin precursor as a main component such that the content of the carbon black is 17% by weight per 100% by weight of the solid content of the polyamic acid, and stirred and mixed well to prepare a substrate coating liquid A.

[Preparation of Polyimide Substrate Belt A]

The coating liquid was uniformly coated by a dispenser on a blasted (roughened) outer surface of a metallic cylindrical mold having an outer diameter of 375 mm and a length of 360 mm while rotated at 50 rpm. After the coating liquid was uniformly coated, the cylindrical mold was placed in a hot air circulation drier while rotated at 100 rpm. The cylindrical mold was gradually heated up to have a temperature of 110° C. for 60 min. Further, the cylindrical mold was heated up to have a temperature of 200° C. for 20 min. The rotation was stopped, and the cylindrical mold a film was formed on was taken out after cooled. The cylindrical mold was placed in a heating (burning) furnace and heated (burned) in stages to have a temperature of 360° C. for 60 min. The cylindrical mold was fully cooled to prepare a polyimide substrate belt A having a thickness of 60 μm.

[Preparation of Surface Layer A]

First, after SeRM Super Polymer SH3400P (from Advanced Softmaterials Inc.) which is polyrotaxane including polyethylene glycol as a straight-chain molecule, adamantane groups as block groups and cyclodextrins having a hydroxyl propyl group as circular molecules, and ARUFON UH-2170 which is a styrene acrylic resin including a hydroxyl group from Toagosei Co., Ltd. were dissolved in cyclohexanone at a solid content ratio of 5/5, DURANATE TPA-B80E which is hexamethylene diisocyanate from Asahi Kasei Corp. [block isocyanate] was placed in the solution such that an equivalent ratio of NCO groups/total of OH groups) was 1.05 to prepare a surface layer coating liquid A.

The SeRM Super Polymer SH3400P which is polyrotaxane has a chemical name of [modified polyrotaxane-graft-polycaprolactone (CAS No. 928045-45-8)]. The straight-chain molecule is polyethylene glycol, the block groups are adamantane groups, and the circular molecules are α-cyclodextrins having a hydroxyl group.

Next, the surface layer coating liquid A was continuously ejected from a nozzle moving in an axial direction of the mold to be spirally coated on the polyimide substrate while rotating the cylindrical mold the polyimide substrate A was formed on. The surface layer coating liquid A was coated in such an amount that the surface layer had a thickness of 100 μm. The cylindrical mold the surface layer coating liquid A was coated on was placed in a hot air circulation drier while rotated, and heated up to 150° C. at 3° C./min for 30 min to prepare an intermediate transfer belt A.

Example 2

The procedure for preparation of the intermediate transfer belt A in Example 1 was repeated to prepare an intermediate transfer belt B except for changing the solid content ratio of the polyrotaxane to the acrylic resin in the surface layer coating liquid A from 5/5 into 3/7.

Example 3

The procedure for preparation of the intermediate transfer belt A in Example 1 was repeated to prepare an intermediate transfer belt C except for changing the solid content ratio of the polyrotaxane to the acrylic resin in the surface layer coating liquid A from 5/5 into 7/3.

Example 4

The procedure for preparation of the intermediate transfer belt A in Example 1 was repeated to prepare an intermediate transfer belt D except for changing the solid content ratio of the polyrotaxane to the acrylic resin in the surface layer coating liquid A from 5/5 into 9/1.

Example 5

The procedure for preparation of the intermediate transfer belt A in Example 1 was repeated to prepare an intermediate transfer belt E except for changing the solid content ratio of the polyrotaxane to the acrylic resin in the surface layer coating liquid A from 5/5 into 1/9, and replacing the dispersion with a dispersion in which carbon black MA100 from Mitsubishi Chemical Corp. was previously dispersed by a beads mill in cyclohexanone and the content of the carbon black into 18% by weight based on total weight of the solid contents in the substrate coating liquid A.

Example 6

The procedure for preparation of the intermediate transfer belt A in Example 1 was repeated to prepare an intermediate transfer belt F except for replacing the ARUFON UH-2170 which is a styrene acrylic resin including a hydroxyl group from Toagosei Co., Ltd. in the surface layer coating liquid A with ARUFON UH-2032 which is an acrylic resin including a hydroxyl group therefrom.

Example 7

The procedure for preparation of the intermediate transfer belt A in Example 1 was repeated to prepare an intermediate transfer belt G except for replacing the ARUFON UH-2170 which is a styrene acrylic resin including a hydroxyl group from Toagosei Co., Ltd. with ARUFON UC-3080 which is a styrene acrylic resin including a carboxyl group therefrom, and placing the DURANATE TPA-B80E which is hexamethylene diisocyanate from Asahi Kasei Corp. [block isocyanate] in the solution such that an equivalent ratio of NCO groups/total of COOH groups and OH groups) was 1.05 in the surface layer coating liquid A.

Example 8

The procedure for preparation of the polyimide substrate belt A was repeated.

[Preparation of Surface Layer H]

First, after SeRM Super Polymer SH3400P (from Advanced Softmaterials Inc.) which is polyrotaxane including polyethylene glycol as a straight-chain molecule, adamantane groups as block groups and cyclodextrins having a hydroxyl propyl group as circular molecules, and LUMIFLON LF200 which is a copolymer of vinylether including trifluoroethylene-hydroxyl group from Asahi Glass Co., Ltd. were dissolved in cyclohexanone at a solid content ratio of 5/5, DURANATE TPA-B80E which is hexamethylene diisocyanate from Asahi Kasei Corp. [block isocyanate] was placed in the solution such that an equivalent ratio of NCO groups/total of OH groups) was 1.05 to prepare a surface layer coating liquid H.

Next, the surface layer coating liquid H was continuously ejected from a nozzle moving in an axial direction of the mold to be spirally coated on the polyimide substrate while rotating the cylindrical mold the polyimide substrate A was formed on. The surface layer coating liquid H was coated in such an amount that the surface layer had a thickness of 100 μm. The cylindrical mold the surface layer coating liquid H was coated on was placed in a hot air circulation drier while rotated, and heated up to 150° C. at 3° C./min for 30 min to prepare an intermediate transfer belt H.

Example 9

The procedure for preparation of the intermediate transfer belt H in Example 8 was repeated to prepare an intermediate transfer belt I except for changing the solid content ratio of the polyrotaxane to the fluororesin in the surface layer coating liquid H from 5/5 into 3/7.

Example 10

The procedure for preparation of the intermediate transfer belt H in Example 8 was repeated to prepare an intermediate transfer belt J except for changing the solid content ratio of the polyrotaxane to the fluororesin in the surface layer coating liquid H from 5/5 into 7/3.

Example 11

The procedure for preparation of the intermediate transfer belt H in Example 8 was repeated to prepare an intermediate transfer belt K except for changing the solid content ratio of the polyrotaxane to the fluororesin in the surface layer coating liquid H from 5/5 into 9/1.

Example 12

The procedure for preparation of the intermediate transfer belt H in Example 8 was repeated to prepare an intermediate transfer belt L except for changing the solid content ratio of the polyrotaxane to the fluororesin in the surface layer coating liquid A from 5/5 into 1/9, and replacing the dispersion with a dispersion in which carbon black MA11 from Mitsubishi Chemical Corp. was previously dispersed by a beads mill in cyclohexanone and the content of the carbon black into 18% by weight based on total weight of the solid contents in the substrate coating liquid H.

Example 13

The procedure for preparation of the intermediate transfer belt H in Example 8 was repeated to prepare an intermediate transfer belt M except for replacing the LUMIFLON LF200 which is a copolymer of vinylether including trifluoroethylene-hydroxyl group from Asahi Glass Co., Ltd. with ZEFFLE GK-510 which is a copolymer of vinylether including a tetrafluoroethylene-hydroxyl group and a carboxyl group from Daikin Industries, Ltd., and placing the DURANATE TPA-B80E which is hexamethylene diisocyanate from Asahi Kasei Corp. [block isocyanate] in the solution such that an equivalent ratio of NCO groups/total of COOH groups and OH groups) was 1.05 in the surface layer coating liquid H.

Comparative Example 1

The procedure for preparation of the intermediate transfer belt A in Example 1 was repeated to prepare an intermediate transfer belt N except for not forming the surface layer.

Comparative Example 2

The procedure for preparation of the intermediate transfer belt A in Example 1 was repeated to prepare an intermediate transfer belt O except for not including the acrylic resin in the surface layer coating liquid A.

Comparative Example 3

The procedure for preparation of the intermediate transfer belt A in Example 1 was repeated to prepare an intermediate transfer belt P except for not including the polyrotaxane resin in the surface layer coating liquid A, and replacing the dispersion with a dispersion in which carbon black MA100 from Mitsubishi Chemical Corp. was previously dispersed by a beads mill in cyclohexanone and changing the content of the carbon black into 21% by weight based on total weight of the solid contents in the substrate coating liquid A.

Comparative Example 4

The procedure for preparation of the intermediate transfer belt H in Example 8 was repeated to prepare an intermediate transfer belt Q except for not including the polyrotaxane resin in the surface layer coating liquid H, and replacing the dispersion with a dispersion in which carbon black MA11 from Mitsubishi Chemical Corp. was previously dispersed by a beads mill in cyclohexanone and the content of the carbon black into 20% by weight based on total weight of the solid contents in the substrate coating liquid H.

Comparative Example 5

The procedure for preparation of the intermediate transfer belt H in Example 8 was repeated to prepare an intermediate transfer belt R except for replacing the LUMIFLON LF200 which is a fluororesin with Dyneon THV-220 from 3M Japan Limited which is a fluororesin having no functional group and cyclohexanone with methyl ethyl ketone from Kanto Chemical Co., Inc.

Example 14

The procedure for preparation of the intermediate transfer belt H in Example 8 was repeated to prepare an intermediate transfer belt S except for replacing the LUMIFLON LF200 which is a fluororesin with SYMAC US-352 which is a silicone acrylic resin including a carboxyl group from Toagosei Co., Ltd., and placing the DURANATE TPA-B80E which is hexamethylene diisocyanate from Asahi Kasei Corp. [block isocyanate] in the solution such that an equivalent ratio of NCO groups/total of COOH groups and OH groups) was 1.05 in the surface layer coating liquid H.

Comparative Example 6

The procedure for preparation of the intermediate transfer belt S in Example 14 was repeated to prepare an intermediate transfer belt T except for not including the polyrotaxane resin in the surface layer coating liquid H, and replacing the dispersion with a dispersion in which carbon black Regal 1400R from Cabot Corp. was previously dispersed by a beads mill in cyclohexanone and changing the content of the carbon black into 17% by weight based on total weight of the solid contents in the substrate coating liquid A.

Example 15

The procedure for preparation of the intermediate transfer belt A in Example 1 was repeated to prepare an intermediate transfer belt U except for further placing MODIPER FS600 which is a fluorine block copolymer including a hydroxyl group and MODIPER FS700 which is a silicone block copolymer from NOF Corp. in the surface layer coating liquid A such that a blend ratio was 48/48/2/2 (SH3400P/UH2170/F600/F700).

The compositions of the surface layer coating liquids in Examples and Comparative Examples are shown in Table 1. Each of the numbers of polyrotaxane and resin therein is a weight ratio.

Each of the intermediate transfer belts A to U was installed in imagio MPC7501 from Ricoh Company, Ltd.

10 images were produced using each of (1) plain paper TYPE 6200 from Ricoh Company, Ltd., (2) Sazanami Paper FC Japanese paper from Ricoh Company, Ltd., and (3) FOX RIVER SELECT SCRIPT WRITING (FOX RIVER).

Images produced on Sazanami Paper FC Japanese paper which is a rough paper having a concave and convex design like Japanese papers tend to have uneven image density and void. Images produced on FOX RIVER SELECT SCRIPT WRITING having many paper powders tend to have spot uneven image density.

A blue solid image including cyan and magenta was produced on each of the (1) and (2), and a black monochrome halftone image was produced on (3).

A second transfer rate was measured, and blade cleanability and abnormal images, i.e., uneven image density, void and spot uneven image density were evaluated. The second transfer rate was calculated by the following formula. An average of the 10 images of each of the papers was used.

Second Transfer rate (%)={([Toner Quantity on Intermediate Transfer Belt before transferred (g)]−[Toner Quantity on Intermediate Transfer Belt after transferred (g)])/[Toner Quantity on Intermediate Transfer Belt before transferred (g)]×100

The worst sample of the 10 images of each of the papers was used to evaluate abnormal images, i.e., uneven image density, void and spot uneven image density.

Cleanability was evaluated using a cleaning blade.

The results are shown in Table 2.

TABLE 1

| | Substrate | | Surface Layer | | | |
|---|---|---|---|---|---|---|
| | | | | Acrylic Resin | | |
| | Belt | Coating Liquid | Polyrotaxane | Acrylic Resin 1 | Acrylic Resin 2 | Acrylic Resin 3 |
| Example 1 | A | Substrate | 5 | 5 | | |
| Example 2 | B | Coating | 3 | 7 | | |
| Example 3 | C | Liquid A | 7 | 3 | | |
| Example 4 | D | (Polyimide | 9 | 1 | | |
| Example 5 | E | Varnish + | 1 | 9 | | |
| Example 6 | F | Carbon Black | 5 | | 5 | |
| Example 7 | G | | 5 | | | 5 |
| Example 8 | H | | 5 | | | |
| Example 9 | I | | 3 | | | |
| Example 10 | J | | 7 | | | |
| Example 11 | K | | 9 | | | |
| Example 12 | L | | 1 | | | |
| Example 13 | M | | 5 | | | |
| Comparative Example 1 | N | | | No Surface Layer | | |
| Comparative Example 2 | O | | 10 | | | |
| Comparative Example 3 | P | | | 10 | | |
| Comparative Example 4 | Q | | | | | |
| Comparative Example 5 | R | | 5 | | | |
| Example 14 | S | | 5 | | | |
| Comparative Example 6 | T | | | | | |

TABLE 1-continued

| | | | | | |
|---|---|---|---|---|---|
| Example 15 | U | | 4.8 | 4.8 | |

| | | Surface Layer Fluororesin | | | |
|---|---|---|---|---|---|
| | Belt | Fluororesin 1 | Fluororesin 2 | Fluororesin 3 | Fluororesin 4 |
| Example 1 | A | | | | |
| Example 2 | B | | | | |
| Example 3 | C | | | | |
| Example 4 | D | | | | |
| Example 5 | E | | | | |
| Example 6 | F | | | | |
| Example 7 | G | | | | |
| Example 8 | H | 5 | | | |
| Example 9 | I | 7 | | | |
| Example 10 | J | 3 | | | |
| Example 11 | K | 1 | | | |
| Example 12 | L | 9 | | | |
| Example 13 | M | | 5 | | |
| Comparative Example 1 | N | | | No Surface Layer | |
| Comparative Example 2 | O | | | | |
| Comparative Example 3 | P | | | | |
| Comparative Example 4 | Q | 10 | | | |
| Comparative Example 5 | R | | | 5 | |
| Example 14 | S | | | | |
| Comparative Example 6 | T | | | | |
| Example 15 | U | | | | 0.2 |

| | | Surface Layer | | |
|---|---|---|---|---|
| | | Silicone Resin | | Carbon Black |
| | Belt | Silicone Resin 1 | Silicone Resin 2 | (Solid Content Ratio) |
| Example 1 | A | | | |
| Example 2 | B | | | |
| Example 3 | C | | | |
| Example 4 | D | | | |
| Example 5 | E | | | 18% |
| Example 6 | F | | | |
| Example 7 | G | | | |
| Example 8 | H | | | |
| Example 9 | I | | | |
| Example 10 | J | | | |
| Example 11 | K | | | |
| Example 12 | L | | | 18% |
| Example 13 | M | | | |
| Comparative Example 1 | N | | No Surface Layer | |
| Comparative Example 2 | O | | | |
| Comparative Example 3 | P | | | 21% |
| Comparative Example 4 | Q | | | 20% |
| Comparative Example 5 | R | | | |
| Example 14 | S | 5 | | |
| Comparative Example 6 | T | 10 | | 17% |
| Example 15 | U | | 0.2 | |

Acrylic Resin 1: Styrene-Acrylic Resin including a Hydroxyl Group
Acrylic Resin 2: Acrylic Resin including a Hydroxyl Group
Acrylic Resin 3: Styrene-Acrylic Resin including a Carboxyl Group
Fluororesin 1: Vinylether Copolymer including a Trifluoroethylene-Hydroxyl Group
Fluororesin 2: Vinylether Copolymer including a Trifluoroethylene-Hydroxyl Group and a Carboxyl Group
Fluororesin 3: Fluororesin having no reactive group
Fluororesin 4: Fluorine Block Copolymer including a Hydroxyl Group
Silicone Resin 1: Silicone Graft Acrylic Resin including a Carboxyl Group
Silicone Resin 2: Silicone Block Copolymer including a Hydroxyl Group

TABLE 2

| | Belt | Second Transfer rate (%) | | |
|---|---|---|---|---|
| | | TYPE 6200 | Sazanami | FOX RIVER |
| Example 1 | A | 87.6 | 87.2 | 87.5 |
| Example 2 | B | 83.8 | 80.6 | 81.9 |
| Example 3 | C | 83.1 | 82.8 | 82.4 |
| Example 4 | D | 82.5 | 80.4 | 80.9 |
| Example 5 | E | 82.9 | 80.4 | 80.8 |
| Example 6 | F | 86.1 | 84.9 | 85.5 |
| Example 7 | G | 84.9 | 84.2 | 84.5 |
| Example 8 | H | 86.7 | 86.3 | 86.6 |
| Example 9 | I | 83.0 | 79.8 | 81.1 |
| Example 10 | J | 82.3 | 82.0 | 81.6 |
| Example 11 | K | 81.7 | 79.6 | 80.1 |
| Example 12 | L | 82.1 | 79.6 | 80.0 |
| Example 13 | M | 84.8 | 83.6 | 84.2 |
| Comparative Example 1 | N | 75.6 | 59.1 | 63.2 |
| Comparative Example 2 | O | 82.1 | 80.3 | 80.4 |
| Comparative Example 3 | P | 83.3 | 59.9 | 64.5 |
| Comparative Example 4 | Q | 81.2 | 60.1 | 64.2 |
| Comparative Example 5 | R | 83.3 | 59.9 | 64.5 |
| Example 14 | S | 85.8 | 85.5 | 84.2 |
| Comparative Example 6 | T | 82.9 | 57.7 | 63.8 |
| Example 15 | U | 91.1 | 90.9 | 89.8 |

| | Belt | Abnormal Images | | | |
|---|---|---|---|---|---|
| | | Uneven Image Density | Void | Spot Uneven Image Density | Clean-ability |
| Example 1 | A | Good | Good | Good | Good |
| Example 2 | B | Good | Good | Good | Good |
| Example 3 | C | Good | Good | Good | Good |
| Example 4 | D | Good | Good | Good | Usable |
| Example 5 | E | Good | Good | Usable | Good |
| Example 6 | F | Good | Good | Good | Good |
| Example 7 | G | Good | Good | Good | Good |
| Example 8 | H | Good | Good | Good | Good |
| Example 9 | I | Good | Good | Good | Good |
| Example 10 | J | Good | Good | Good | Good |
| Example 11 | K | Good | Good | Good | Good |
| Example 12 | L | Good | Good | Good | Good |
| Example 13 | M | Good | Good | Good | Good |
| Comparative Example 1 | N | Unusable | Unusable | Unusable | Good |
| Comparative Example 2 | O | Good | Good | Usable | Unusable |
| Comparative Example 3 | P | Unusable | Unusable | Unusable | Good |
| Comparative Example 4 | Q | Unusable | Unusable | Unusable | Good |
| Comparative Example 5 | R | Usable | Good | Unusable | Good |
| Example 14 | S | Good | Good | Good | Good |
| Comparative Example 6 | T | Unusable | Unusable | Unusable | Good |
| Example 15 | U | Good | Good | Good | Good |

Comparative Examples 1, 3, 4 and 6 prove a polyimide group surface layer, or the surface layer including an acrylic resin, a fluororesin or a silicone resin alone have low followability to Sazanami paper and poor concave and convex transferability because of being hard. Further, FOX RIVER paper has very poor spot uneven image density. Comparative Example 2 proves the cleaning blade could not remove an untransferred toner from the surface layer including polyrotaxane alone although having practically usable transferability.

Examples 1 to 7 prove the surface layer including a crosslinked material formed of polyrotaxane and an acrylic resin has both transferability and cleanability.

Examples 8 to 14 prove the surface layer including a crosslinked material formed of polyrotaxane and an acrylic resin (or a silicone resin) has both transferability and cleanability. However, the surface layer in Comparative Example 5, in which a fluororesin and polyrotaxane were not crosslinked, had uneven transfer (image density) due to uneven distribution of materials.

The surface layer in Example 15, in which polyrotaxane, an acrylic resin, a fluororesin and a silicone resin were crosslinked has the best result in all Examples.

Having now fully described the invention, it will be apparent to one of ordinary skill in the art that many changes and modifications can be made thereto without departing from the spirit and scope of the invention as set forth therein.

What is claimed is:

1. An intermediate transferer, comprising:

a substrate; and a surface layer overlying the substrate, wherein the surface layer comprises a crosslinked material, comprising:

a polyrotaxane, comprising:

a circular molecule;

a straight-chain molecule including the circular molecule in a skewering form; and a block group located at both ends of the straight-chain molecule, preventing the circular molecule from releasing, at least one resin selected from the group consisting of acrylic resins, fluororesins and silicone resins, and at least one hardener, wherein the at least one hardener includes block isocyanate, wherein a ratio of NCO groups in the block isocyanate to a total of OH groups in a combination of the polyrotaxane and the at least one resin in the surface layer is in a range from 1.0 to 1.2.

2. The intermediate transferer of claim 1, wherein the acrylic resin has a hydroxyl group.

3. The intermediate transferer of claim 1, wherein the acrylic resin is a styrene-acrylic resin.

4. The intermediate transferer of claim 1, wherein the fluororesin is a copolymer comprising a structural unit coming from fluoroethylene and a structural unit coming from a vinylether group.

5. The intermediate transferer of claim 1, wherein the fluororesin is a copolymer of tetrafluoroethylene and vinylether.

6. The intermediate transferer of claim 1, wherein the fluororesin is a copolymer of trifluoroethylene and vinylether.

7. The intermediate transferer of claim 1, wherein the silicone resin has at least one functional group selected from the group consisting of hydroxyl groups and carboxyl groups.

8. The intermediate transferer of claim 1, wherein a solid content ratio of the polyrotaxane to the at least one resin selected from the group consisting of acrylic resins, fluororesins and silicone resins in the surface layer is from 3/7 to 7/3 by weight.

9. The intermediate transferer of claim 1, wherein the intermediate transferer is a seamless belt.

10. An image forming apparatus, comprising:

an image bearer a latent image is formed on;

an image developer configured to develop the latent image with a toner to form a toner image on the image bearer;

the intermediate transferer according to claim 1, the toner image is first transferred onto; and a transferer configured to transfer the toner image on the intermediate transferer onto a recording medium.

11. The image forming apparatus of claim 10, wherein the image forming apparatus is a full-color image forming apparatus comprising plural image bearers in series, each having an image developer for each color.

12. An intermediate transferer, comprising:

a substrate; and a surface layer overlying the substrate, wherein the surface layer comprises a crosslinked material, comprising:

a polyrotaxane, comprising:

a circular molecule;

a straight-chain molecule including the circular molecule in a skewering form; and a block group located at both ends of the straight-chain molecule, preventing the circular molecule from releasing, at least one resin selected from the group consisting of acrylic resins, fluororesins and silicone resins, and at least one hardener, wherein the at least one hardener includes block isocyanate, wherein a ratio of NCO groups in the block isocyanate to a total of OH groups in a combination of the polyrotaxane and the at least one resin in the surface layer is in a range from 1.0 to 1.2, wherein the acrylic resin is a styrene-acrylic resin, wherein the fluororesin is a copolymer of tetrafluoroethylene and vinylether or a copolymer of trifluoroethylene and vinylether, and wherein the silicone resin has at least one functional group selected from the group consisting of hydroxyl groups and carboxyl groups.

13. The intermediate transferer of claim 12, wherein the surface layer comprises an acrylic resin, a fluororesin, and a silicone resin.

14. The intermediate transferer of claim 13, wherein the surface layer comprises 10-98% acrylic resin by weight, 1-45% fluororesin by weight, and 1-45% silicone resin by weight.

15. The intermediate transferer of claim 1, wherein the surface layer has a thickness in a range from 30 μm to 300 μm.

* * * * *